United States Patent [19]

Wagatsuma et al.

[11] Patent Number: 4,749,827

[45] Date of Patent: Jun. 7, 1988

[54] SLIDER OF A SLIDE SWITCH

[75] Inventors: Tadashi Wagatsuma; Kenji Hiwatashi, both of Furukawa, Japan

[73] Assignee: Alps Electric Co., Ltd., Japan

[21] Appl. No.: 68,774

[22] Filed: Jun. 25, 1987

Related U.S. Application Data

[63] Continuation of Ser. No. 860,532, May 7, 1986, abandoned.

[30] Foreign Application Priority Data

May 7, 1985 [JP] Japan ..... 60-67615[U]

[51] Int. Cl.[4] ..... H01H 15/04

[52] U.S. Cl. ..... 200/16 D; 200/16 C

[58] Field of Search ..... 200/1 R, 11 D, 11 DA:11 G, 200/11 J, 11 TW, 16 R, 16 C, 16 D, 6 R, 61.45 R, 292

[56] References Cited

U.S. PATENT DOCUMENTS

| | | | |
|---|---|---|---|
| 2,853,565 | 9/1958 | Arthur et al. | 200/16 D |
| 3,261,928 | 7/1966 | Schlesinger, Jr. | 200/16 D X |
| 4,029,914 | 6/1977 | Schmidt et al. | 200/16 D X |
| 4,095,060 | 6/1978 | Keprda | 200/16 D |
| 4,316,067 | 2/1982 | Whiteman, Jr. | 200/16 D X |
| 4,326,110 | 4/1982 | Zdanys, Jr. | 200/16 D X |
| 4,376,234 | 3/1983 | Liataud et al. | 200/16 R |
| 4,529,851 | 7/1985 | Priebe et al. | 200/16 D |

*Primary Examiner*—J. R. Scott

*Attorney, Agent, or Firm*—Guy W. Shoup

[57] ABSTRACT

A slide switch has a pair of opposed, fixed terminals provided on a wafer, and a movable slider contact having two pairs of bifurcated movable contact portions at both ends for slidably contacting the fixed terminals to open or close the switch. Precious metal plating is provided on one pair of the bifurcated movable contact portions at one end of the movable slider contact but not on the other pair of bifurcated movable contact portions at the other end of the movable slider contact.

1 Claim, 1 Drawing Sheet

SLIDER OF A SLIDE SWITCH

This is a continuation application from application Ser. No. 860,532, filed May 7, 1986, now abandoned.

FIELD OF THE INVENTION

This invention relates to a slide switch, and more particularly to an improvement of a slider of a so-called dip switch configured to slidably move the slider to or away from a pair of fixed terminals on a wafer to close or open the switch.

BACKGROUND OF THE INVENTION

The most usual prior art dip switch has a structure shown in FIGS. 4 6. In these drawings, fixed terminals 2 are provided on a wafer 1 and spaced by a distance from each other. A slider assembly 3 consists of a knob 4 integrally projecting from the upper surface thereof and movable contacts 3*a* and 3*b* at both lower ends thereof, so that the slider 3 is slidably moved via the knob 4 to bring the movable contacts 3*a* and 3*b* into or away from contact with the fixed terminals 2.

Since the fixed terminals 2 in the prior art dip switch arrangement are significantly spaced, contacts 2*a* at the opposed ends of the fixed terminals 2 most usually plated by a sheet of hoop of gold or other precious metal require a significant length A of the hoop. Also, since the slider 3 is configured to use both ends as movable contacts 3*a* and 3*b* for engagement or disengagement with respect to the fixed contacts 2*a*, both movable contacts 3*a* and 3*b* require gold or other precious metal plating. Therefore, the prior art dip switch arrangement increases the amount of gold or other precious metal.

OBJECT OF THE INVENTION

It is therefore an object of the invention to provide a slider of a slide switch which saves the amount of gold or other precious metal used for plating.

SUMMARY OF THE INVENTION

The most broad feature of the invention is to provide only one of movable contacts of a slider of a slide switch with precious metal plating. More specifically, in a slide switch including a wafer, a pair of opposed, fixed terminals provided on said wafer, and a slider having bifurcated movable contacts at both ends for slidably contacting said fixed terminals, precious metal plating is provided on one of said movable contacts at one end of the slider but not on the other movable contact at the other end of the slider.

DETAILED DESCRIPTION

Figure 1:
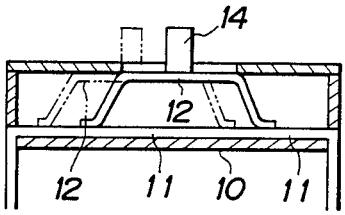
FIG. 1 is a cross-sectional view of a dip switch having an improved slider embodying the invention.

The invention will be better understood from the description given below, referring to a preferred embodiment illustrated in the drawings.

Figure 2:
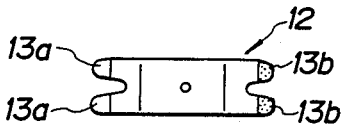
FIG. 2 is a plan view of the slider of FIG. 1.
Figure 3:
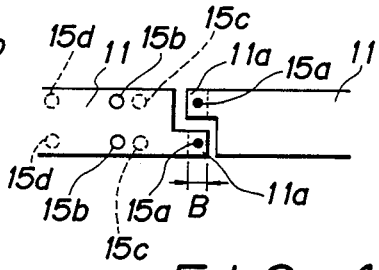
FIG. 3 is a plan view of fixed terminals shown in FIG. 1.
Figure 5:
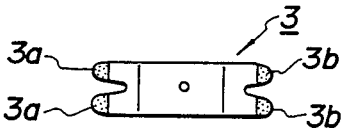
FIG. 5 PRIOR ART
FIG. 5 is a plan view of a slider shown in FIG. 4.
Figure 4:
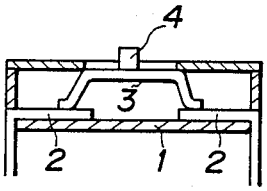
FIG. 4 PRIOR ART
FIG. 4 is a cross-sectional view of a prior art dip switch.
Figure 6:
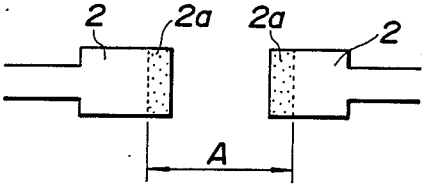
FIG. 6 PRIOR ART
FIG. 6 is a plan view of fixed terminals shown in FIG. 4.

Referring to FIGS. 1 through 3, a wafer 10 carries a pair of opposed fixed terminals 11. The fixed terminals 11 have L-shaped or offset opposed ends so that projecting ends 11*a* thereof serving as fixed contacts interdigitate with each other with a crooked spacing channel therebetween so as to substantially align in the width direction of the fixed terminals 11. The interdigitating fixed contacts 11*a* can be fully plated by a sheet of hoop of gold or other precious metal with a narrow length B.

A slider assembly 12 is substantially trapezoid and has a knob 14 projecting upward from the upper surface to receive a force for slidably moving the slider 12. The slider 12 has bifurcated movable contact portions 13*a* and 13*b* at both ends. However, due to the interdigitating structure, fixed terminals 11 can be connected by a single pair of bifurcated movable contact portions 13*b*, for example, which are engageable with the fixed contacts 11*a*, straddling the spacing channel therebetween. Therefore, gold or other precious metal plating may simply be provided on the single pair of bifurcated movable contact portions 13*b* at one end and not on the contacts 13*a* at the other end.

During the on-state of the switch, the plated movable contact portions 13*b* take positions 15*a* (FIG. 3) overlapping the fixed contacts 11*a*, and the unplated movable contact portions 13*a* take positions 15*b* apart from fixed contacts 11*a*. However, unplated movable contact portions 13*a* take positions 15*c* and 15*d* both apart from fixed contacts 11*a* to open the switch.

As described, the inventive construction largely saves the amount of gold or other plating precious metal and hence reduces the manufacturing cost of the switch.

The embodiments of the invention in which an exclusive property or privilege is claimed are defined as follows:

1. A slide switch comprising:

a wafer;

a pair of fixed terminals having a given width and being aligned with and spaced apart from each other in a longitudinal direction on said wafer, wherein one fixed terminal has an end facing opposite to an end of the other fixed terminal, and the ends of the fixed terminals are each configured in the shape of the letter L having one portion projecting toward the other fixed terminal, said L-shaped projecting portions of the fixed terminals being in parallel with and spaced apart from each other across the width of the fixed terminals in a transverse direction perpendicular to the longitudinal direction of said wafer, so that they form interdigitated contact ends in the transverse direction spaced apart by a longitudinal channel in between, a slider assembly which is movable in the longitudinal direction of the fixed terminals for forming a bridging contact between the interdigitated contact ends of the fixed terminals, said assembly having ends disposed in the longitudinal direction and having a bifurcated movable contact portion at each end, each of said bifurcated movable contact portions having a pair of contact ends spaced apart from each other in the transverse direction movable into widthwise bridging contact with the interdigitated contact ends of the fixed terminals;

wherein only one bifurcated movable contact portion at one end of the slider assembly is provided with a precious metal plating on its pair of contact ends.

* * * * *

UNITED STATES PATENT AND TRADEMARK OFFICE

CERTIFICATE OF CORRECTION

PATENT NO. : 4,749,827

DATED : June 7, 1988

INVENTOR(S) : Tadashi Wagatsuma et al.

It is certified that error appears in the above-identified patent and that said Letters Patent is hereby corrected as shown below:

Title of Patent: "SLIDER OF A SLIDE SWITCH" should read --SLIDE SWITCH HAVING INTERDIGITATED FIXED CONTACTS AND BIFURCATED MOVABLE SLIDER CONTACT--.

Signed and Sealed this

Fourth Day of April, 1989

*Attest:*

DONALD J. QUIGG

*Attesting Officer*

*Commissioner of Patents and Trademarks*